United States Patent [19]

Warren et al.

[11] 3,973,155

[45] Aug. 3, 1976

[54] INCANDESCENT SOURCE OF VISIBLE RADIATIONS

[75] Inventors: Roger W. Warren; Donald W. Feldman, both of Pittsburgh, Pa.

[73] Assignee: Westinghouse Electric Corporation, Pittsburgh, Pa.

[22] Filed: Jan. 31, 1975

[21] Appl. No.: 546,058

[52] U.S. Cl. ..... 313/218; 75/207; 313/211; 313/345

[51] Int. Cl.[2] ..... H01J 1/15

[58] Field of Search ..... 313/222, 341, 345, 110, 313/218, 315, 211–213; 315/116; 75/207

[56] References Cited

UNITED STATES PATENTS

| | | | |
|---|---|---|---|
| 2,614,942 | 10/1952 | Loosjes et al. | 313/341 X |
| 3,429,832 | 2/1969 | Carter | 313/218 X |
| 3,558,966 | 1/1971 | Hill et al. | 313/341 X |
| 3,745,403 | 7/1973 | Misumi | 313/218 X |

*Primary Examiner*—John Kominski
*Attorney, Agent, or Firm*—W. D. Palmer

[57] ABSTRACT

Incandescent source of visible radiations comprises a refractory support member having a thin, refractory material layer thereover, with both the support and the thin layer adapted to be heated to high temperatures. The material comprising the thin layer is highly absorptive for visible radiations and thus is a correspondingly good emitter for such visible radiations, and the material comprising the thin layer is highly transmissive for infrared radiations and a correspondingly poor emitter for such infrared radiations. Minute optical discontinuities in the thin layer act to scatter infrared radiations and the infrared radiations which are generated in the support member are scattered back to the support member in order to contribute to the heating of same. Visible radiations, in contrast, are absorbed and emitted by the thin layer so that this layer is a very selective radiator. In this manner, infrared radiations generated in the support member are selectively scattered to contribute to the heating of the support member and thus the generation of more visible radiations which the thin layer emits.

7 Claims, 6 Drawing Figures

INCANDESCENT SOURCE OF VISIBLE RADIATIONS

CROSS-REFERENCE TO RELATED APPLICATION

In copending application Ser. No. 546,152 filed concurrently herewith, titled "Refractory-Oxide-Based Incandescent Radiators And Method Of Making" by Laurence H. Cadoff, and owned by the present assignee, is described an incandescent radiator which is formed of a cermet which has sufficient room-temperature-conductivity that it can be self-resistance heated to an incandescent condition. In its preferred form, the radiator comprises a support member having provided thereover a thin oxide coating, constructed in accordance with the present invention, in order to improve the visible-radiation-emission characteristics of the radiator.

BACKGROUND OF THE INVENTION

This invention relates to incandescent sources of visible radiations and, more particularly, to a refractory oxide incandescent source of visible radiations which selectively emits visible radiations while scattering infrared radiations, which scattered infrared radiations contribute to the generation of more visible radiations.

Refractory-oxide incandescent lamps are known, such as generally described in U.S. Pat. No. 3,412,286, dated Nov. 19, 1968. Such refractory oxide incandescent radiators are not specially constructed to selectively emit visible while scattering infrared radiations, and the efficiency of these radiators is not as good as desired.

The well-known Wellsbach mantle is initially formed as a silk or cotton fiber mantle-shaped support which is impregnated with ceria-doped thoria. The impregnating material remains in self-sustaining mantle form when the silk or cotton fiber is burned off. Apparently the mantle owes its bright appearance to its very high emissivity in the visible spectrum, although the emissivity of thoria in the infrared region of the spectrum is very low.

In copending application Ser. No. 552,834 filed Feb. 25, 1975 by R. W. Warren, one of the coinventors herein and owned by the present assignee, is disclosed a thermal collector of solar energy wherein a powdered, elemental semi-conductor absorbs the solar energy and longer wavelength re-radiation of absorbed energy is greatly reduced by the use of the powered layer which scatters and does not absorb the longer wavelength radiation, thereby permitting operation at a high temperature such as 300°C. The present incandescent source operates at a much higher temperature, such as 2000°C.

SUMMARY OF THE INVENTION

There is provided an incandescent source of visible radiations which comprises a refractory material supporting member with a thin layer of refractory material overlaying the supporting member, and means are provided for heating the supporting member and overlaying thin layer to a high temperature. The material of the thin layer is so selected that when in an incandescent state it has an absorptivity in the visible region of the spectrum which very substantially exceeds its absorptivity in the infrared region of the spectrum. The physical structure of the thin layer exhibits a large number of minute optical discontinuities of such size that the average spacing between successive discontinuities causes visible radiations propagated in the thin layer to be substantially absorbed before traversing the distance from one discontinuity to the next succeeding discontinuity. Infrared radiations which are propagated in the thin layer are only minimally absorbed while traversing the distance from one discontinuity to the next succeeding discontinuity. Since the absortivity of any material is equal to its emissivity, the visible radiations are strongly emitted from the thin layer and the infrared radiations are at most only poorly emitted. The infrared radiations, however, are scattered because of the thin-layer optical discontinuities and in this manner contribute to the further heating of the supporting member, which in turns generates more total radiations. The thickness of the thin layer exceeds by at least several times the average spacing between the successive optical discontinuities in the structure of the thin layer. There is also provided a protective radiation-transmitting means which surrounds the support member and thin layer and which encloses an environment that is non-reactive with respect to the support member and the thin layer.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
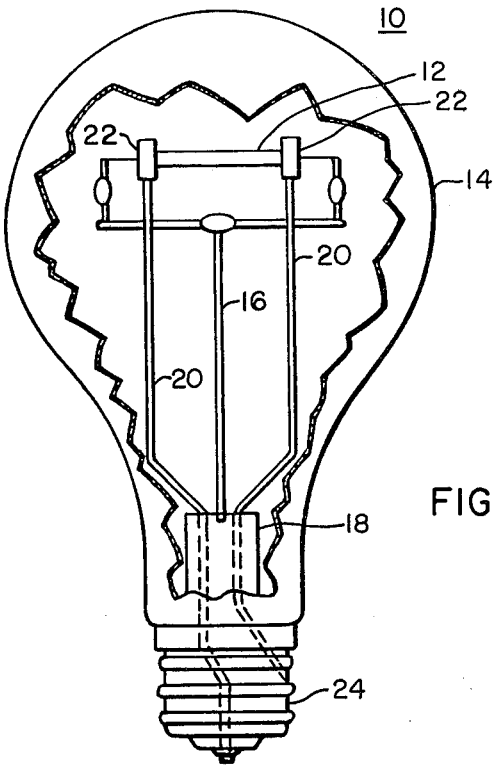
FIG. 1 is an elevational view, partly broken away, illustrating an incandescent light source which incorporates an incandescent element fabricated in accordance with the present invention.

With reference to the form of the invention illustrated in the drawings, the incandescent lamp 10 as shown in FIG. 1 corresponds to the lamp as shown in the aforementioned copending application Ser. No. 546,152, filed concurrently herewith and briefly comprises the incandescent element or source 12 which is operatively positioned and supported within the protective radiation-transmitting means which encloses an environment that is nonreactive with respect to the incandescent source 12. In this embodiment the protective means is a conventional glass envelope 14. The incandescent source 12 is supported within the envelope 14 by means of suitable supports 16 which extend from a conventional stem press 18. Electrical lead-in conductors and supports 20 connect to tungsten contact-support members 22 and thus to the ends of the incandescent source 12. The leads 20 also connect to the screw base 24 in order to permit energization of the source 12 to an incandescent condition. Suitable atmospheres for operating the source 12 are nitrogen or inert gas.

Figure 2:
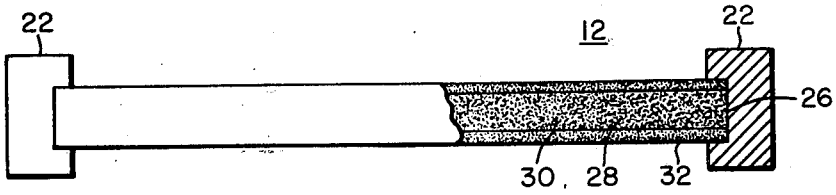
FIG. 2 is a enlarged elevational view, shown partly in section, illustrating construction details for the incandescent element of the lamp as shown in FIG. 1.

The incandescent source in its preferred form is shown in FIG. 2 wherein the radiator source 12 is constructed in accordance with the technique described in said copending application Ser. No. 546,152, filed concurrently herewith. This source 12 is adapted for operation at a predetermined electric potential, such as 110–120 volts, applied across the ends thereof in order to cause it to incandesce. The source 12 is formed of an elongated body portion 26 which principally comprises sintered refractory oxide 28, which in a pure state appears generally light in color. Discrete refractory metal particles 30 are dispersed throughout the oxide in amount of from about 8 volume percent to about 20 volume percent of the body portion 26, and the dispersed refractory metal particles display therebetween sufficient electrical continuity to enable the radiator source 12 to be self-resistance heated to an incandescent state upon application of the operating potential across the ends thereof. The presence of the refractory metal particles given the body portion 26 a grey appearance which increases greatly its omission in the near infrared and in order to decrease same, there is provided over the body portion 26 a thin sintered layer 32 of the same oxide, which layer 32 overlays and is adhered to the body portion 26. The preferred materials for forming the layer 32 will be described hereinafter.

Figure 3:
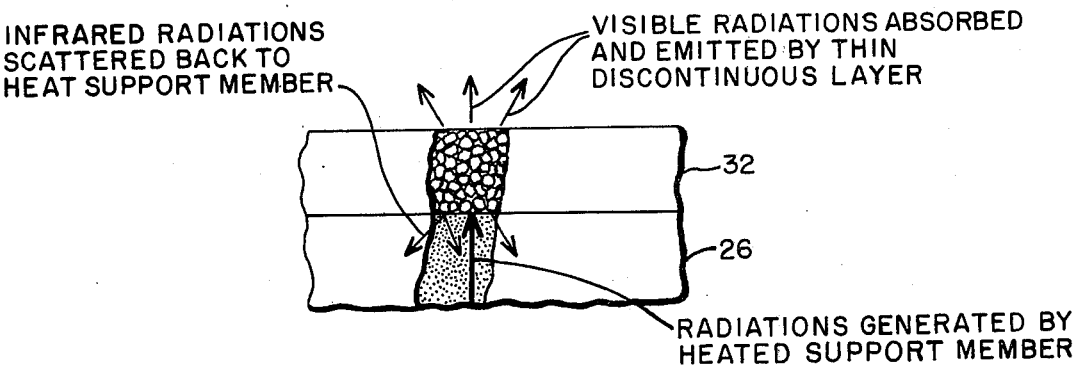
FIG. 3 is a schematic view with accompanying legends, illustrating the mechanism by which visible radiations are very efficiently generated by the present incandescent source.

In FIG. 3 is shown a schematic view illustrating the mechanism by which the infrared emission is minimized and the visible radiation emission is enhanced. The thin layer 32 which overlays the supporting or base member 26 is formed of a material which, when in an incandescent state, has an absorptivity in the visible region of the spectrum which very substantially exceeds its absorptivity in the infrared region of the spectrum. Specific materials which meet this criteria are chromia-doped alumina, chromia-doped magnesia or chromia-doped calcia, and chromia-doped alumina is preferred. Ceria-doped thoria can also be used. Because of the doping, these refractory oxides are highly absorptive in the visible region of the spectrum and they remain quite transmissive in the infrared region of the spectrum. Since absorptivity is equal to emissivity, these materials are very emissive in the visible region of the spectrum. The physical structure of the thin layer 32 also exhibits a plurality of minute optical discontinuities, which in the schematic showing of FIG. 3 are illustrated as minute voids between particulate material. It should be understood, however, that these optical discontinuities can be formed by small voids such as could remain in a layer of sintered material, or they can comprise small segregations of materials which have a different index of refraction from that of the primary material of which layer 32 is formed. These optical discontinuities are extremely minute, and the average spacing between successive discontinuities is not critical. As an example, the average spacing between successive discontinuities in the structure of the thin layer 32 is from 1 micron to 10 microns, with a specific spacing being about 2 microns. With a material such as chromia-doped alumina, the minute spacing will result in visible radiations which are propagated in the thin layer 32 being substantially absorbed before traversing the distance from one discontinuity to the next succeeding discontinuity. In contrast, infrared radiations which are propagated in such a thin layer are only minimally absorbed while traversing the distance from one discontinuity to the next succeeding discontinuity. The thickness of the thin layer is such that it exceeds by at least several times the average spacing between successive discontinuities in this thin layer structure. As a specific example, the thin layer has a thickness which exceeds by about ten times the average spacing between successive discontinuities. Thus if this average spacing is 2 microns, the thin layer 32 can have a thickness of about 20 microns.

Considering further the mechanism by which the visible radiations are enhanced, the heated support member 26, such as is illustrated in FIGS. 2 and 3, causes radiations to be generated and directed toward the overlying layer 32. These generated radiations include both visible radiations and infrared radiations and the layer 32 is heated throughout its thickness to a state of incandescence, an example of the heating temperature being 2100°K. The visible radiations are emitted therefrom. The infrared radiations, in contrast, are not absorbed by the material of the layer 32, but rather are scattered due to the different indicies of refraction encountered at the optical discontinuities, and this scattering causes the infrared radiations to be directed back toward the body or support member 26, in order to contribute to its heating and thus the generation of more total radiations, both visible and infrared. As an example the material of the thin layer, when in an incandescent state, has an absorptivity in the visible region of the spectrum which exceeds by at least 100 times its absorptivity in the infrared region of the spectrum. In this manner, infrared radiations are directed back to their source, in order to generate more total radiations, and the visible radiations which are generated are emitted from the incandescent body.

As a specific example for preparing chromia-doped alumina, 98 weight percent finely divided alumina is mixed with 2 weight percent finely divided chromia and the mixture dry ballmilled for 16 hours. Firing this mixture at 1700°C in an oxidizing atmosphere will form the chromia-doped alumina. To form the body portion 26 of the incandescent source in the manner as disclosed in aforementioned copending application Ser No. 546,142, filed concurrently herewith, the chromia-doped alumina is mixed with about 8 to 20 volume percent of tungsten powder and formed into a self-sustaining member using "tape" technology. The resulting tape is provided with the desired configuration and it is initially sintered to set same. The resulting member is then heated to a temperature such as about 1600°C in an inert atmosphere while subjecting same to the influence of an electric field of about 8 volts (rms)/mm. Thereafter the thin layer of chromia-doped alumina 32 is sintered onto the surface of the resulting cermet member, or the surface portions of the metal in the cermet member are oxidized to form the porous layer 32.

In the case of most incandescent sources, tungsten filament lamps being an example, the higher the operating temperature, the higher the brightness and the greater the operating efficiency for the generation of visible radiations. Conversely, the higher the operating temperature, the shorter the life of the tungsten incandescent source because of increased evaporation, chemical reactions, and other operating problems encountered at very high incandescent temperatures. Incandescent sources constructed in accordance with the present invention have been incandesced at a lower temperature than tungsten filaments with an operating efficiency for the generation of visible light which exceeds that of tungsten as operated in a 25 watt lamp.

Figure 4:
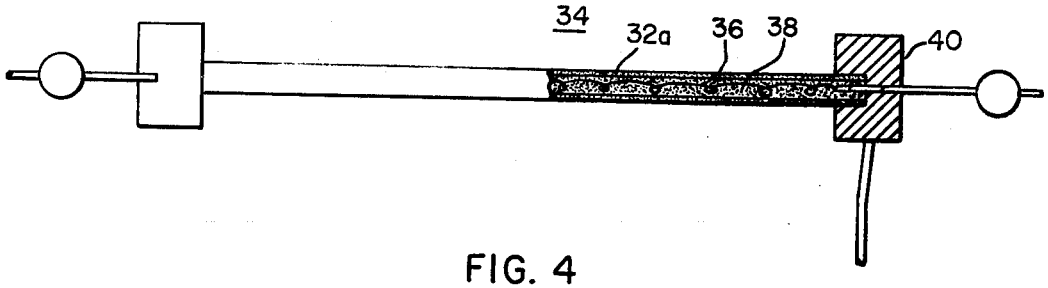
FIG. 4 is an enlarged elevational view, shown partly in section, illustrating an alternative construction for the incandescent element.
Figure 5:
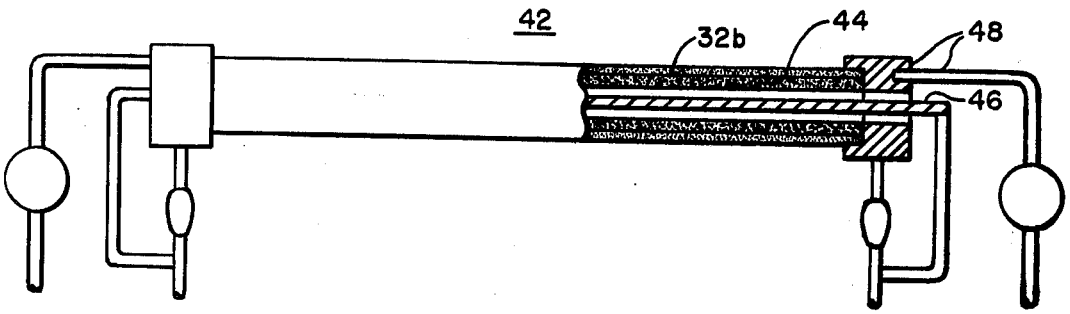
FIG. 5 is an enlarged elevational view, shown partly in section, illustrating yet another alternative construction for the incandescent element.
Figure 6:
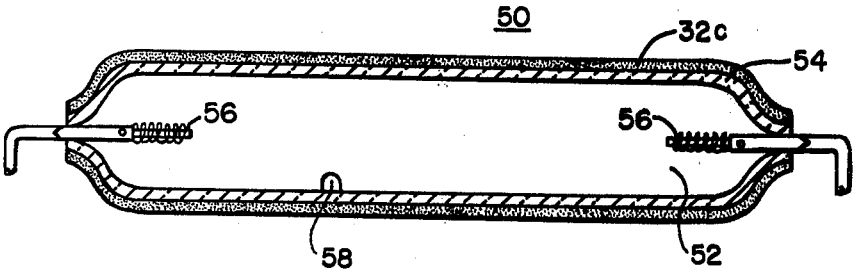
FIG. 6 is an enlarged sectional view showing still another embodiment for the incandescent element wherein the heating source is a plasma.

In the following alternative embodiments as shown in FIG. 4 through 6, only the alternative incandescent source or element along with a limited portion of the support therefor will be shown, and these alternative incandescent element embodiments can be mounted in an incandescent lamp structure as shown in FIG. 1.

In FIG. 4 is shown an alternative embodiment 34 which comprises a tungsten element heater coil 36 embedded in a sintered core 38 of refractory oxide such as aluminum oxide mounted on suitable refractory metal supports 40. Coated thereover is a thin layer 32*a* of the present refractory material which preferably is chromia-doped alumina.

FIG. 5 is shown yet another embodiment 42 which can be incorporated into the lamp structure as shown in FIG. 1 wherein a sintered aluminum oxide tube 44 is adapted to surround a spaced, tungsten heater element 46. The radiations generated by the tungsten element 46 heat the spaced surrounding alumina tube 44 to a condition of incandescence and this tube 44 has placed thereon the thin layer 32*b* of chromia-doped alumina which emits the visible radiations and scatters the infrared radiations back toward the heater element 46 in order to enhance the efficiency for the generation of visible radiations. The support structure 48 is modified somewhat to support the tube 44 in spaced relationship from the tungsten heater 46.

Yet another alternative embodiment 50 is shown in FIG. 6 wherein a discharge device is provided with a sintered alumina envelope 54, discharge-sustaining electrodes 56 are operatively sealed through and positioned proximate the ends thereof, and a discharge-sustaining charge of mercury 58 and a low pressure of inert ionizable starting gas are also included within the sealed envelope 54. Provided over the exterior of the envelope 54 is a thin layer 32*c* of the present refractory radiation-emissive material, such as chromia-doped alumina. When the device 52 is operated to generate a discharge between the electrodes 56, the resulting heat causes the envelope 54 to incandesce and the efficiency of generation of visible radiations is enhanced by the layer 32*c* in the manner as described hereinbefore.

Other methods of heating the thin layer of selective emissive material 32 and its support member may be devised and the mechanism by which the efficiency of generation of visible radiations is enhanced will remain the same. For example, the base or support member could be heated by an electron beam or a laser, and the generation of visible radiations will be enhanced in a manner similar to that described hereinbefore.

We claim:

1. An incandescent source of visible radiations, said source comprising:

a. a refractory material supporting member, and means for heating said supporting member to a high temperature;

b. a thin refractory material layer overlaying said supporting member, means for heating all of said thin layer to an incandescent state, the material of said thin layer when in an incandescent state having an absorptivity in the visible region of the spectrum which very substantially exceeds its absorptivity in the infrared region of the spectrum, the physical structure of said thin layer exhibiting a plurality of spaced minute optical discontinuities, the average spacing between successive discontinuities in said thin layer structure being such that visible radiations propagated in said thin layer are substantially absorbed before traversing the distance from one discontinuity to the next succeeding average-spaced discontinuity and infrared radiations propagated in said thin layer are minimally absorbed while traversing the distance from one discontinuity to the next succeeding average-spaced discontinuity, and said thin layer having a thickness exceeding by at least several times the average spacing between successive discontinuities in said thin layer structure; and c. protective radiation-transmitting means surrounding said supporting member and said thin layer and enclosing an environment which is non-reactive with respect to said supporting member and said thin layer.

2. The incandescent source as specified in claim 1, wherein said supporting member when heated to a high temperature is emissive in the infrared region of the spectrum, and said thin layer is heated to an incandescent state by heat transferred from said supporting member.

3. The incandescent source as specified in claim 1, wherein the material of said thin layer when in an incandescent state has an absorptivity in the visible region of the spectrum which exceeds by at least 100 times its absorptivity in the infrared region of the spectrum.

4. The incandescent source as specified on claim 1, wherein said supporting member is heated to a high temperature by self-resistance heating, and said thin layer is formed of refractory oxide.

5. The incandescent source as specified in claim 1, wherein the average spacing between discontinuities in the structure of said thin layer is from 1 to 10 microns, and the thickness of said thin layer exceeds by at least about 10 times the average spacing between discontinuities in the structure of said thin layer.

6. The incandescent source as specified in claim 5, wherein said thin layer is formed of chromia-doped alumina.

7. The incandescent source as specified in claim 6, wherein the average spacing between discontinuities in the structure of said thin layer is about 2 microns, and the thickness of said thin layer is about 20 microns.

* * * * *